US005620361A

United States Patent [19]

Aylesworth

[11] Patent Number: 5,620,361

[45] Date of Patent: Apr. 15, 1997

[54] SANDING ACCESSORY AND METHOD

[76] Inventor: Perry J. Aylesworth, 5901 Cypress St., Zephyrhills, Fla. 33540

[21] Appl. No.: 608,560

[22] Filed: Feb. 28, 1996

[51] Int. Cl.[6] ..... B24B 1/00

[52] U.S. Cl. ..... 451/59; 451/303; 451/305; 451/396; 451/444; 451/453

[58] Field of Search ..... 451/305, 296, 451/406, 241, 282, 334, 170, 444; 83/155.1

[56] References Cited

U.S. PATENT DOCUMENTS

| | | | |
|---|---|---|---|
| 279,075 | 6/1883 | Berry | 451/396 |
| 3,753,269 | 8/1973 | Budman | 451/444 |
| 4,221,081 | 9/1980 | Everett | 451/453 |
| 4,257,195 | 3/1981 | Appelgren | 451/305 |
| 4,267,671 | 5/1981 | Rettew | 451/305 |
| 4,438,601 | 3/1984 | Olson | 451/444 |
| 4,924,633 | 5/1990 | Hock et al. | 451/303 |

FOREIGN PATENT DOCUMENTS

| | | | |
|---|---|---|---|
| 1025752A | 3/1958 | Germany | 451/296 |

*Primary Examiner*—Bruce M. Kisliuk
*Assistant Examiner*—George Nguyen
*Attorney, Agent, or Firm*—Charles A. McClure

[57] ABSTRACT

Sanding accessory for a conventional belt sander or the like, enabling manually held workpieces to be sanded to a super-smooth finish without rounding off their edges. A workpiece held by hand sideways against a fence parallel to the direction of travel of the belt moves forward by belt friction to a crosswise face of the fence and is retained there as the fence reciprocates laterally across the belt and back, sanding the workpiece evenly and distributing the belt wear uniformly over substantially its entire abrasive surface.

21 Claims, 2 Drawing Sheets

SANDING ACCESSORY AND METHOD

TECHNICAL FIELD

This application relates to mechanically assisted smoothing or "sanding" of workpieces of wood or similarly workable materials, and concerns especially mechanically assisted holding of sandable workpieces so as to ensure uniformity of resulting smoothed surfaces.

BACKGROUND OF THE INVENTION

Manual sanding of wooden articles is a slow process and has as an additional disadvantage that manual sanding, despite the best of intentions or skills, undesirably tends to round off square corners.

The sanding process can be expedited by mechanical movement of the sanding surface against the workpiece. Belt sanders are well known, as in U.S. Patents to Mooney, U.S. Pat. No. 3,482,358; Pollak, U.S. Pat. No. 3,538,650; and Johannsen, U.S. Pat. No. 4,628,640. Yet manual holding of the workpiece still tends to result in rounding of workpiece corners intended to be square—and accompanying unintended abrasion of fingertips, etc.

Examples of mechanized holding of repetitive workpieces are found in Crouch and Hoganson U.S. Pat. No. 5,092,081, and in Numao and Miyajima U.S. Pat. No. 5,179,805—especially where sanding of multiple curvatures is important. For simpler curve working, spindle sanders are used on drill presses reciprocated to even the wear on the sanding spindles. Automating such reciprocation is known, as pointed out by Ianuzzi in U.S. Pat. 4,821,457; and by Bill Krier in WOOD, The World's Leading Woodworking Magazine, September 1994, pp. 78–82.

My main interest focuses upon the sanding of plane surfaces by mechanically assisted manual holding of a workpiece in combination with effective mechanical moving of the workpiece as most desirable.

SUMMARY OF THE INVENTION

A primary object of the present invention is sand flat sides of workpieces of wood or other sandable material to super-smoothness.

Another object of this invention is to sand workpieces without rounding corners intended to be mutually perpendicular.

A further object of the invention is to vary relative motion of the sanding surface against the workpiece to avoid producing wear patterns on the sanding surface.

Yet another object of this invention is to collect particles abraded from the workpiece and/or worn from the sanding surface.

A still further object of the invention is to attain various of the foregoing objects by means of a traversing fence for workpieces.

In general, the objects are achieved, using an upstanding fence traversable just above a horizontal sanding surface traveling toward and past the fence, by holding the workpiece against the sanding surface and laterally against a fence face parallel to the travel direction, while enabling friction with the sanding surface to propel the workpiece against a crosswise fence face, and by simultaneously traversing the fence—with the adjacent workpiece—across the travel direction to assure even wear of both workpiece and sanding surface.

Conveniently, an accessory for a belt sander is provided having a workpiece-guiding fence with two planar workpiece-contacting faces respectively parallel to and crosswise of the belt travel direction, plus laterally reciprocatable fence-traversing means. Included is a drive member pivotally attached to the fence and extending laterally to drive mechanism adapted to reciprocate the drive member to traverse the fence—plus workpiece—repeatedly across the belt and back.

This new accessory preferably is readily attachable to, and detachable from, a bench or stand supporting the underlying sanding apparatus, and preferably also aids in removal of particles abraded from the workpiece and/or from the sanding surface, as by brushing and even optionally vacuum-cleaning the sanding surface.

Other objects of this invention, together with methods and means for attaining the various objects, will become apparent from the following description and the accompanying diagrams of at least one embodiment, presented by way of example rather than limitation.

SUMMARY OF TEE DRAWINGS

Figure 3:
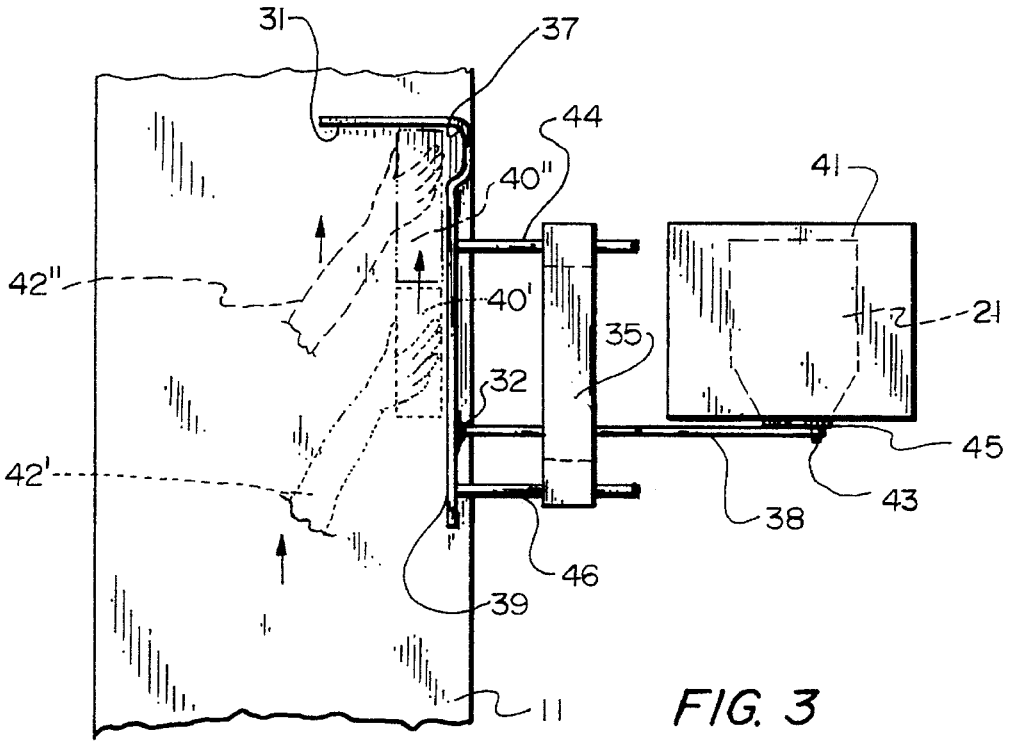
Figure 4:
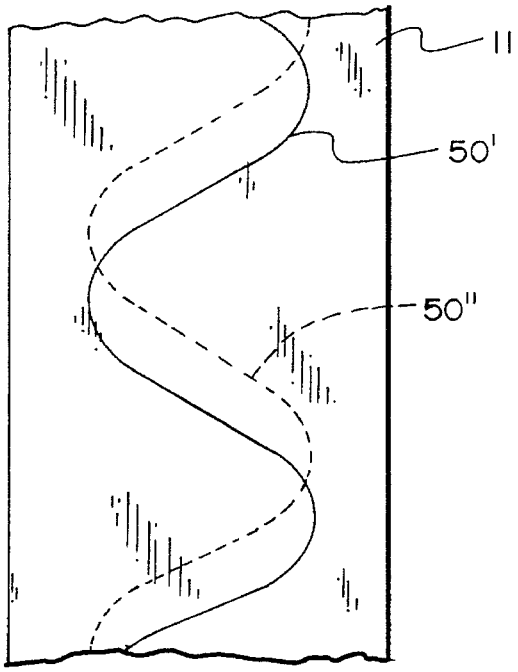

FIG. 3 is a top plan of the accessory of the preceding views with its workpiece-retaining fence positioned near the right extreme of its side-to-side traversing (arrows) relative to the lengthwise travel direction (arrow) of the underlying sanding belt surface; and FIG. 4 is a top plan of a substantial portion of the underlying sanding surface indicating successive offset paths (broken lines) of the same workpiece fence and same lengthwise traveling belt.

DESCRIPTION OF THE INVENTION

Figure 1:
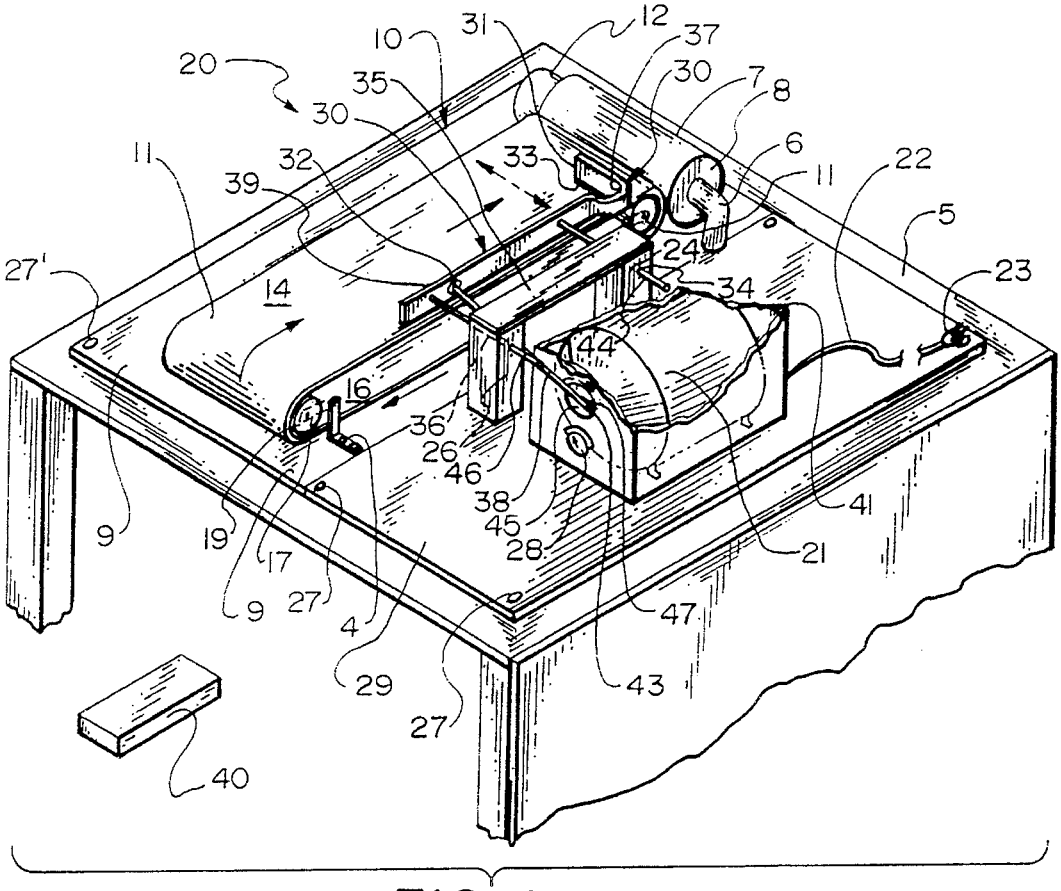
FIG. 1 is a perspective view of a preferred embodiment of the present invention installed as an accessory to a common belt sander.

FIG. 1 shows, in perspective (viewed from above, at right rear) accessory embodiment 20 of the present invention, shown installed as an adjunct to common belt sander 10. Workpiece 40 of wood, or other material to be smoothed by the sander, is shown apart from it here.

The sander features front and rear cylindrical rolls 11 and 19, front roll drive motor 12, right rear roll support 4, and screw-operated spacing-adjustment means 17. Abrasive-faced endless belt 11 travels about paired front and rear rolls, upper flight 14 traveling forward as lower flight 16 returns. Usual accessory components include cover 7 over the down-curving front end, exhaust fan 8 to facilitate collection of the particles dislodged from the workpiece being sanded and from the abrading surface of the belt itself, and tubing 6 to a remote bag or like collection means (not shown here).

Workbench 5 provides a supporting surface for conventional belt sander 10 on baseplate 9, and for accessory 20 of this invention on baseplate 29, respectively secured in place by fasteners 27' and 27.

Upstanding from bottom plate 27 are narrow transverse supports 24 and 26, tied together at their top by strap 35, and having respective transverse bores (one each) 34 and 36 near their top ends. Extending slidably through the respective bores are horizontal fence-support rods 44 and 46 fastened at their leftmost ends to back or outside edge of face 39 of fence 30, whose lower surface overlies (spaced just above) sanding belt 11. Upstanding at the lower right is motor-support hood 41, shown cut away overhead in this view to reveal drive motor 21 supported by it. The motor is provided with adjustable speed control 28 and with electrical cord 22 having plug 23 to engage an external power outlet (not shown). Drive shaft 47 extends from the near end of the motor through a bore in the hood to eccentric drive member 45 carrying offset pivot pin 43. Fence-traversing rod 38 connects pivotally at one of its ends to pivot joint 32 on fence face 39 and at its opposite end to pivot pin 43.

Fence 30 is generally right-angled in plan, including face 39 extending parallel to the direction of movement of the sanding belt, and intersecting face 31 crosswise of the belt—and supporting brush means 33 underneath it in contact with the belt. The fence faces are adapted to receive workpiece 40 (or a similar workpiece) and retain it in the resulting corner, which has concavity 37 in face 39 here conducive to clearing of particles dislodged from belt or workpiece.

Figure 2:
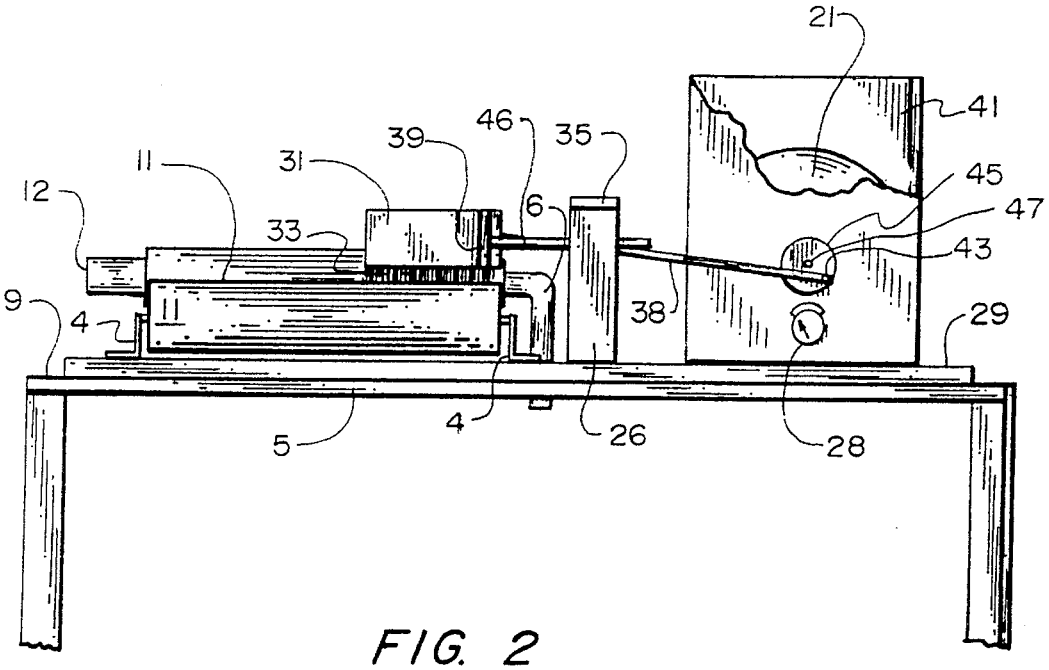
FIG. 2 is a rear elevation of the FIG. 1 apparatus accessory, with directions of rotation and reciprocation indicated by arrows.

FIG. 2 shows, in rear elevation, the FIG. 1 apparatus accessory with directions of rotation and reciprocation indicated by arrows, including the lateral reciprocation of fence 30 by traversing rod 38 via rotating eccentric drive member 45. The reciprocating fence is supported by the pair of laterally reciprocating horizontal support rods (46 visible and 44 hidden behind it). Those rods support the fence with its bottom edge spaced just above, and brush means 33 extending downward into contact with, the abrasive surface of upper flight 14 of sanding belt 11, whose aftmost extent is visible here passing upward about its rear roll 19 preparatory to traveling horizontally (away from the field of view). Re-identification of other FIG. 1 features also in this view is omitted as superfluous.

FIG. 3 shows, in top plan, apparatus accessory 30 with parallel fence face 39 near the rightmost edge of its traverse path relative to the underlying visible top surface of top flight 14 of sanding belt 11, which travels from rear to front (arrows). Fragmentarily shown are a human arm and hand in brief initial position 42' (dotted lines) and continuing working position 42" (dashed lines), as are the workpiece initial position 40' and workpiece final position 40". Fence traversing is conveniently absent (or ignored) in this view.

FIG. 4 shows, fragmentarily in plan, the traversing path(s) of the fence (and workpiece) for successive revolutions of belt 11 as generally sinusoidal. As an example, in successive belt revolutions the midpoint of the transverse part of the fence traces sinusoidal initial path 50' (solid line) and longitudinally displaced successive path 50" (broken line) along and above (without contacting) the belt surface. The next and each additional run will displace the path incrementally further along the belt, thus favoring even wear of the belt surface. In the unlikely event that the fence might make an exact number of traverses in the time that the belt makes one complete revolution, thus superimposing successive paths, the operator can readily discontinue such undesirable superposition by adjusting control 28 to vary the traversing rate. A slower rate will stretch the path lengthwise, displacing the sidewise excursions further apart along the belt, whereas a faster traversing rate will have the opposite effect of longitudinally compressing the overall pattern. The traverse path depends upon the eccentricity of the drive member, being wider if more eccentric, and narrower if less eccentric.

Contacting the sanding surface of belt 11 with the brush means aids in collection of solid particles dislodged from the workpiece and/or the sanding surface and traces a sinusoidal path, similar to the line(s) in FIG. 4 but with the width of the brush means, and in actual contact with the belt surface. Such brushing is effective to push dislodged particles along the belt before (and facilitating) their collection, as by vacuum withdrawal into a bag (not shown) so that, when a given part of the abrasive belt surface again meets the work surface, the abrasive will not be clogged from a previous run.

Operation of the apparatus accessory of this invention should be apparent from the foregoing description and these supplementary remarks. A human operator desiring to sand a workpiece places it firmly but yieldably into contact with the parallel fence face and lightly onto the belt spaced somewhat aft of the crosswise face. If or as soon as the sander is running, the workpiece is propelled by its greater friction with the traveling abrasive belt surface along the parallel face and into a final or working position relative to the fence, in contact with the crosswise face at the fence corner. If and when the drive motor of this invention is actuated, the workpiece can be traversed across the belt and back. The workpiece may be held in place against the fence by a clip or similar device, but preferably the human operator holds it manually at the (usually) right-angled junction of the fence faces and with a yielding arm follows the crosswise traversing movement of the fence while maintaining the workpiece fixed relative to the fence corner.

Unaided attempts to hold a workpiece manually against a sanding belt—even without moving it laterally in an effort to even out the belt wear—inevitably result in rounded edges instead of the flat sanded surface(s) usually desired. Unaided attempts to traverse such a workpiece across the belt and back aggravate the rounding of the workpiece edges and can never be consistent enough to result in the even belt wear that the accessory of this invention provides.

Other advantages, such as ease and replicability of operation, and enhanced safety, will accrue to practitioners of this invention.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The invention claimed is:

1. A workpiece-holding accessory for a typical belt sander or similar sanding means having a traveling planar sanding surface, comprising a workpiece fence having workpiece-contacting faces adapted to be based substantially vertically close to and upstanding from such sanding surface traveling in a substantially horizontally plane; and fence-traversing means including a drive member attached at one end to the fence and attached at an opposite end to drive mechanism adapted to reciprocate the drive member and thus the attached fence crosswise of the direction of travel of the sanding surface.

2. The accessory of claim 1, wherein the workpiece fence has two workpiece-contacting faces, each of the respective faces being substantially planar over at least most of its extent, and intersecting each other along a substantially vertical line.

3. The accessory of claim 2, wherein the respective faces are contiguous but one curves outward from the substantially vertical intersecting line of their respective planes.

4. The accessory of claim 3, wherein at least one of the substantially planar faces has a concave portion curving outward in the vicinity of the other face relative to the location of a workpiece against both faces.

5. The accessory of claim 2, wherein the workpiece-contacting faces are mutually perpendicular, with one such face lengthwise, and the other such face crosswise, relative to the direction of travel of the sanding surface.

6. The accessory of claim 5, including particulate-removal means supported by and depending from the fence to the traveling sanding surface.

7. The accessory of claim 6, wherein the particulate-removal means includes a brush in contact with and adapted to move across the traveling sanding surface.

8. The accessory of claim 1, wherein the mechanism adapted to move the drive member to traverse the fence laterally across the sanding surface and back includes a motor with a rotating drive shaft and an eccentric interconnection to the pivotal drive member.

9. The accessory of claim 8, wherein the motor is adapted to rotate its drive shaft at any of a range of speeds, and including a speed control adapted to be set within that range to reciprocate the fence relative to the sanding belt travel direction as desired.

10. The accessory of claim 8, including a frame with a base supporting both the workpiece fence and the fence-traversing means.

11. The accessory of claim 8, including fastener means adapted to affix the accessory base in place relative to an affixed sanding means and thus determine the traversing path of the workpiece fence relative to lengthwise direction of travel of the sanding surface.

12. The accessory of claim 11, including means for adjusting the extent of the traverse path crosswise of the sanding surface.

13. In combination, a workpiece-holding accessory according to claim 1 and a belt sander with an adjacent horizontally traveling sanding surface.

14. Sanding apparatus, comprising sanding means having a substantially flat horizontally and unidirectionally lengthwise traveling sanding surface of given traversable width; and an overlying upstanding workpiece fence having workpiece-contacting faces spaced vertically close to and extending upward from the underlying sanding surface traveling past the fence; and fence-traversing means including substantially horizontally reciprocatable guide members attached to the fence, a drive member pivotally attached to the fence and laterally to mechanism adapted to move the drive member and reciprocate the fence across and back the sanding surface relative to its lengthwise travel direction.

15. Apparatus according to claim 14, including means for varying the rate of traverse of the fence relative to the rate of lengthwise travel of the sanding surface.

16. Apparatus according to claim 14, including fence-supported means for brushing from the vicinity particles resulting from the sanding.

17. Apparatus according to claim 16, including means for collecting brushed particles resulting from the sanding.

18. Workpiece fence-traversing mechanism, comprising generally right-angled workpiece-holding fence means having respective crosswise and longitudinally extending upright faces with their lower edges adapted to be spaced closely above longitudinally traveling horizontal workpiece-working means and adapted to receive a workpiece thereagainst in the right angle thereof and be held in fixed relationship thereagainst for traversing movement therewith;

supporting means spacing the fence means above but close to the horizontal plane of travel of workpiece-working means thereunder;

traversing means connected to the fence means and thereby operative to reciprocate the fence means from side to side crosswise of longitudinal travel of the the working means, and adjustable in (a) traverse width, or (b) traverse rate, or (c) both (a) and (b).

19. Mechanism according to claim 18, wherein the traversing means includes a traverse rod pivotally connected at one of its ends to the fence means and connected at its opposite end to rotatable eccentric drive means, being adapted to vary the traverse width of the fence means upon adjustment in extent of eccentricity.

20. Mechanism according to claim 19, wherein the traversing means includes rotary motive means adjustable to vary the speed of rotation of the eccentric drive means, being adapted to vary the traverse rate of the fence means upon adjustment in such speed.

21. Mechanism according to claim 18, including attachment means for attaching the mechanism to a workbench or the like in operatively close proximity to a belt sander whose abrasive surface is adapted to constitute the longitudinally traveling horizontal workpiece-working means.

* * * * *